United States Patent [19]

Beasley

[11] 4,375,196

[45] Mar. 1, 1983

[54] CUTTING MECHANISM FOR CUT PILE TUFTING MACHINE

[75] Inventor: Max M. Beasley, Lookout Mountain, Ga.

[73] Assignee: Tuftco Corporation, Chattanooga, Tenn.

[21] Appl. No.: 312,875

[22] Filed: Oct. 19, 1981

[51] Int. Cl.[3] ..... D05C 15/24

[52] U.S. Cl. ..... 112/79 R

[58] Field of Search ..... 112/79 R, 79 A, 79 FF, 112/79.5, 78

[56] References Cited

U.S. PATENT DOCUMENTS

| | | | |
|---|---|---|---|
| 2,335,487 | 11/1943 | Cobble et al. | 112/79 R |
| 3,084,645 | 1/1963 | Card | 112/79 R |
| 4,003,321 | 1/1977 | Card | 112/79 R |
| 4,048,930 | 9/1977 | Card | 112/79 A |

*Primary Examiner*—H. Hampton Hunter

*Attorney, Agent, or Firm*—Harrington A. Lackey

[57] ABSTRACT

A loop cutting apparatus for a cut pile tufting machine including looper hooks, for cooperating with corresponding reciprocal needles, mounted in a hook bar supported on a looper rocker arm for pivotal movement about a hook shaft, the knives cooperating with the looper hooks being fixed in a knife bar supported on a lever member mounted for pivotal movement on the looper rocker arm, and a drive mechanism operatively connected to the looper rocker arm and the lever member for reciprocally moving the rocker arm and lever member simultaneously in opposite directions for cooperative movement of the knives and hooks to form cut pile. The loop cutting apparatus is further characterized by locating the pivotal axis of the lever member at an elevated position upon the looper rocker arm so that the movement of the knives relative to the looper hooks is substantially vertical, thereby requiring less reciprocal movement of the hooks and knives for effectively cutting the loops seized by the hooks.

9 Claims, 5 Drawing Figures

CUTTING MECHANISM FOR CUT PILE TUFTING MACHINE

BACKGROUND OF THE INVENTION

This invention relates to tufting machines, and more particularly to a knife mechanism for a cut pile tufting machine.

In conventional cut pile tufting machines, the looper hooks are mounted on a transverse hook bar, which in turn is operatively connected to a reciprocal hook shaft, while the cutting knives are mounted on a transverse knife bar, which in turn is operatively supported upon an independent reciprocal knife shaft. The independent hook shaft and knife shaft are reciprocally driven in timed relationship through a drive linkage mechanism at one end of the machine. The looper-knife drive mechanism is also linked to the needle drive mechanism to effect synchronism reciprocation between the needles, hooks, and knives for forming and cutting the loops of yarn carried through the base fabric by the needles. Some of these typical cut pile looper drive mechanisms are disclosed in the following U.S. patents:

U.S. Pat. No. 3,084,645—R. T. Card—Apr. 9, 1963

U.S. Pat. No. 4,048,930—R. T. Card—Sept. 20, 1977

Not only do the above cited U.S. patents disclose independent hook shafts and knife shafts, but the rotary axis of the knife shafts are substantially below the plane of movement of the base fabric and also substantially below the bills of the hooks, so that when the knives are reciprocated, they have substantial longitudinal as well as vertical movement.

It has been found that the most effective cutting action between a looper and a knife is the vertical portion of the movement of the knife relative to the hook bill for cooperating in a scissors action with the lower cutting edge of the bill of the looper hook.

One type of looper-cutting apparatus for forming cut pile tufted fabric, utilizing a scissors action in which a knife is pivotally connected to each looper, and a single drive shaft, is disclosed in the prior Cobble et al U.S. Pat. No. 2,335,487, issued Nov. 30, 1943, for "MULTIPLE NEEDLE TUFTING MACHINE." In this patent each knife is adjustably secured to a bell-crank bracket pivotally fixed to each hook. One arm of the bell-crank bracket supports the knife, while the other depending arm of the bell-crank bracket is pivotally connected to a fixed support. Thus, as the loop hooks are reciprocated, the cooperating knives will automatically reciprocate to cut the loops on the retracted or rear stroke of the loop hooks.

These Cobble loop-cut devices we actually manufactured but were not utilized very long, because of the limited wear-life of the pivot bolts securing each knife bracket to its corresponding loop hook. Furthermore, since there had to be a bell-crank bracket supporting a knife, for each loop hook, considerable space was occupied by the loop hooks, the knives, pivotal knife brackets and looper arms beneath the needle plate. Accordingly, the narrowness of the needle gauge was limited by the Cobble looper-cutting apparatus.

SUMMARY OF THE INVENTION

It is therefore an object of this invention to provide a cutting mechanism adapted to be utilized with an existing looper hook support and drive mechanism in a multiple needle cut pile tufting machine to provide a more efficient loop cutting operation.

Another object of this invention is to provide a looper apparatus for a cut pile tufting machine in which the conventional reciprocal knife shaft is eliminated and a knife support bracket is cooperatively mounted upon the looper hook support mechanism.

It is a further object of this invention to provide in a cut pile tufting machine having rocker arms supporting a hook bar carrying a plurality of loop hooks, a knife support bracket which is pivotally connected in an elevated position upon each rocker arm and linked to a common drive shaft for the looper rocker arm and the knife support bracket.

More specifically, the cutting mechanism is particularly adapted to cooperate with a conventional loop hook mounting and drive mechanism in which one or more hook bars is supported at the upper ends of a plurality of spaced rocker arms, the lower end of each rocker arm is pivotally mounted upon a hook shaft, and a jack shaft is provided for driving the looper rocker arms through link bars, such as that disclosed in FIG. 1 of the above R. T. Card U.S. Pat. No. 4,048,930. However, instead of mounting the knives and knife bar upon a separate knife shaft, one or more knife bars is mounted on a plurality of spaced knife brackets, each knife bracket having a lever member, the upper end of which is pivotally mounted upon a corresponding looper rocker arm. The lower end of each lever member is operatively connected by a pivotal link bar to the same drive jack shaft operatively connected to the looper rocker arms. However, each looper link bar is pivotally connected to the jack shaft above the pivotal axis of the jack shaft while each corresponding knife drive link bar is connected to the jack shaft below the pivotal axis of the jack shaft, to effect an alternating, simultaneous push-pull motion to the looper rocker arm and the lever member when the jack shaft is reciprocally rotated.

Furthermore, the pivotal axis of the lever member is at an elevated position, as near the top portion of the looper rocker arm as possible, so that the pivotal action of the knives relative to the bills of the hooks is substantially vertical. The elevated position of the pivotal axis substantially eliminates most of the longitudinal movement of the knives relative to the hooks.

Transverse adjustment means are provided between each knife bar, or knife bar module, and the corresponding knife bracket, so that after the cutting mechanism is assembled upon the looper rocker arms, the knife bars or modules may be easily and quickly moved transversely in either direction to properly set and tension the knives relative to their corresponding hooks.

DESCRIPTION OF THE PREFERRED EMBODIMENTS

Figure 1:
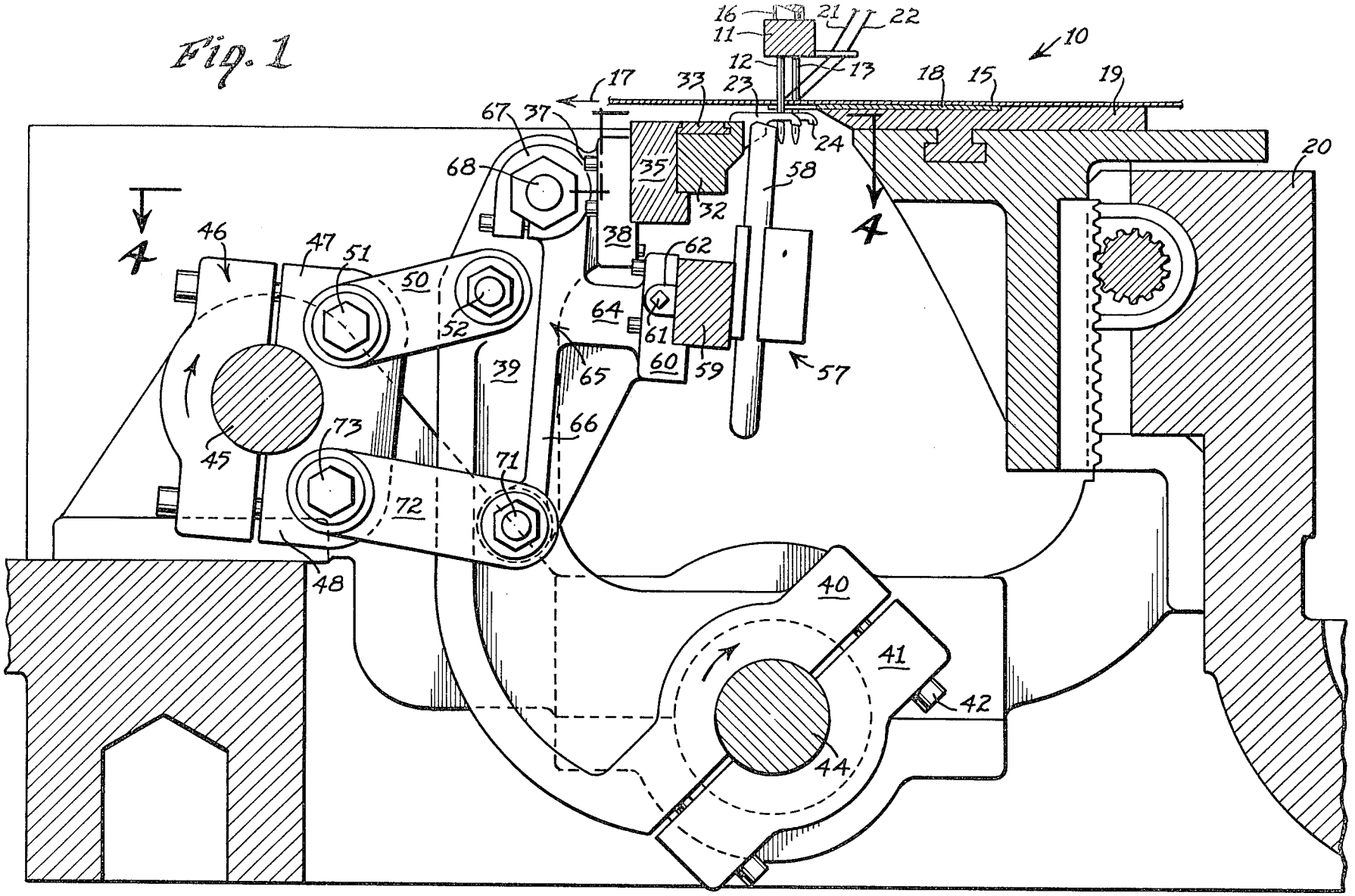
FIG. 1 is a fragmentary, sectional elevation of a portion of a cut pile tufting machine incorporating the cutting mechanism made in accordance with this invention, in a loop-forming position.

Referring now to the drawings in more detail, FIG. 1 discloses a fragmentary portion of a staggered needle cut pile tufting machine 10 including a typical transverse needle bar 11 supporting a plurality of needles 12 in a first or rear transverse row, and a plurality of needles 13 in a second or front transverse row spaced longitudinally forward of the first row of needles 12. The needle bar 11 is adapted to reciprocally move between the lower position disclosed in FIG. 1 penetrating the base fabric 15, and an upper position disclosed in FIGS. 2 and 5, above the base fabric 15, by a push rod 16, driven by conventional means, not shown.

Figures 2, 3:
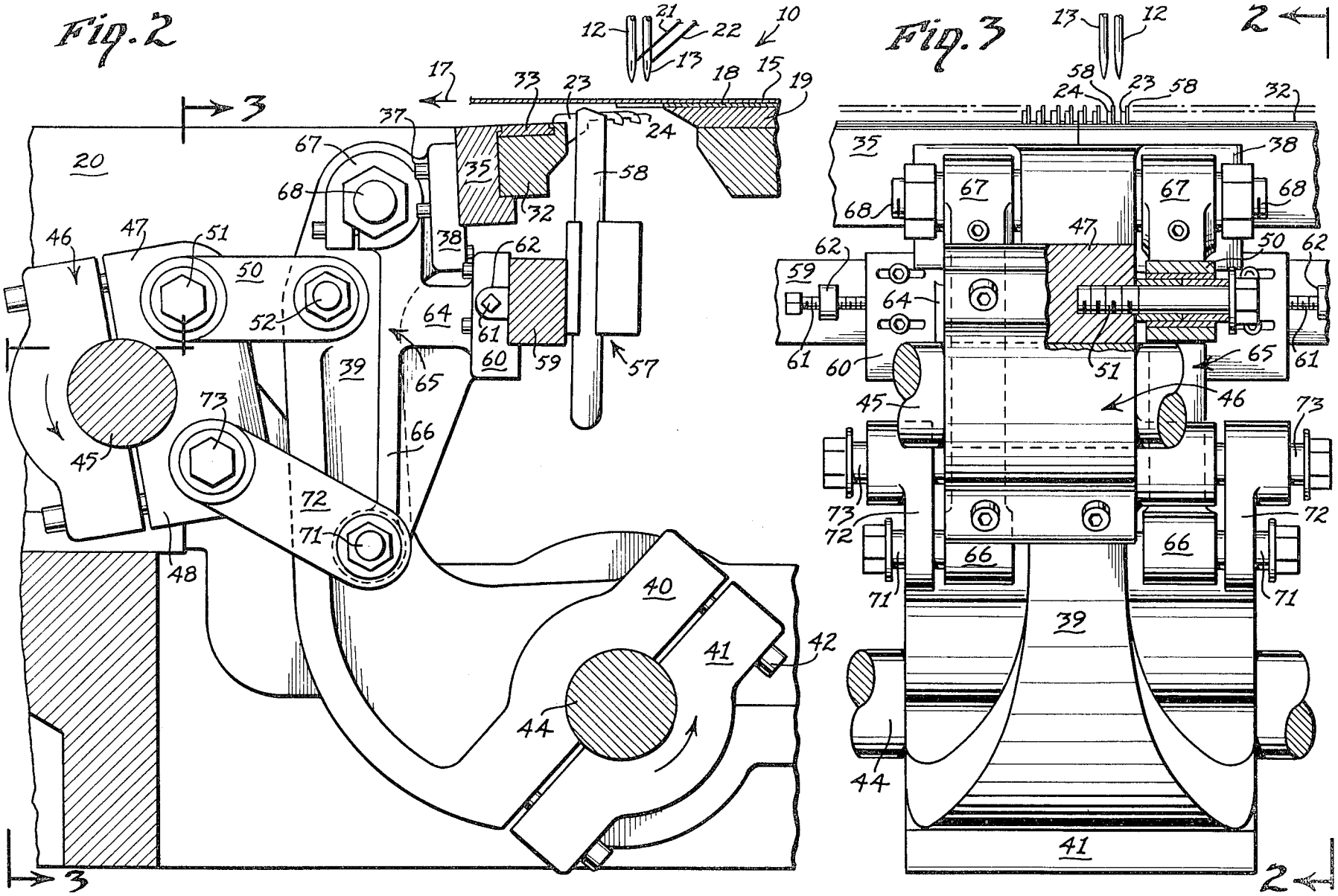
FIG. 2 is a fragmentary, sectional elevation, similar to FIG. 1, taken along the line 2—2 of FIG. 3, of the machine in a loop-cutting position.
FIG. 3 is a fragmentary section taken along the line 3—3 of FIG. 2.

As best disclosed in FIGS. 2 and 3, the needles 12 in the first row, and the needles 13 in the second row, are alternately staggered transversely of the tufting machine 10. The needles in the same row are preferably equidistant from each other, as well as being equidistantly staggered from the needles in the other row.

The base fabric 15 is supported for longitudinal movement from front to rear in a feeding direction, indicated by the arrow 17, upon a needle plate 18 supported upon the bed plate 19 on the frame 20 of the machine 10.

Each rear needle 12 carries a yarn 21 and each front needle 13 carries a yarn 22 through the base fabric 15 upon each stroke of the needle bar 11.

The looper apparatus made in accordance with this invention may include staggered hooks. However, the looper apparatus disclosed in the drawings includes the transversely aligned hooks 23 and 24 having transversely aligned throats 25, and bills 26 and 27 of unequal lengths, so that the free ends 28 and 29 of the bills are staggered correspondingly with the needles 12 and 13, as taught in the Card U.S. Pat. No. 4,003,321, issued Jan. 18, 1977.

Figure 5:
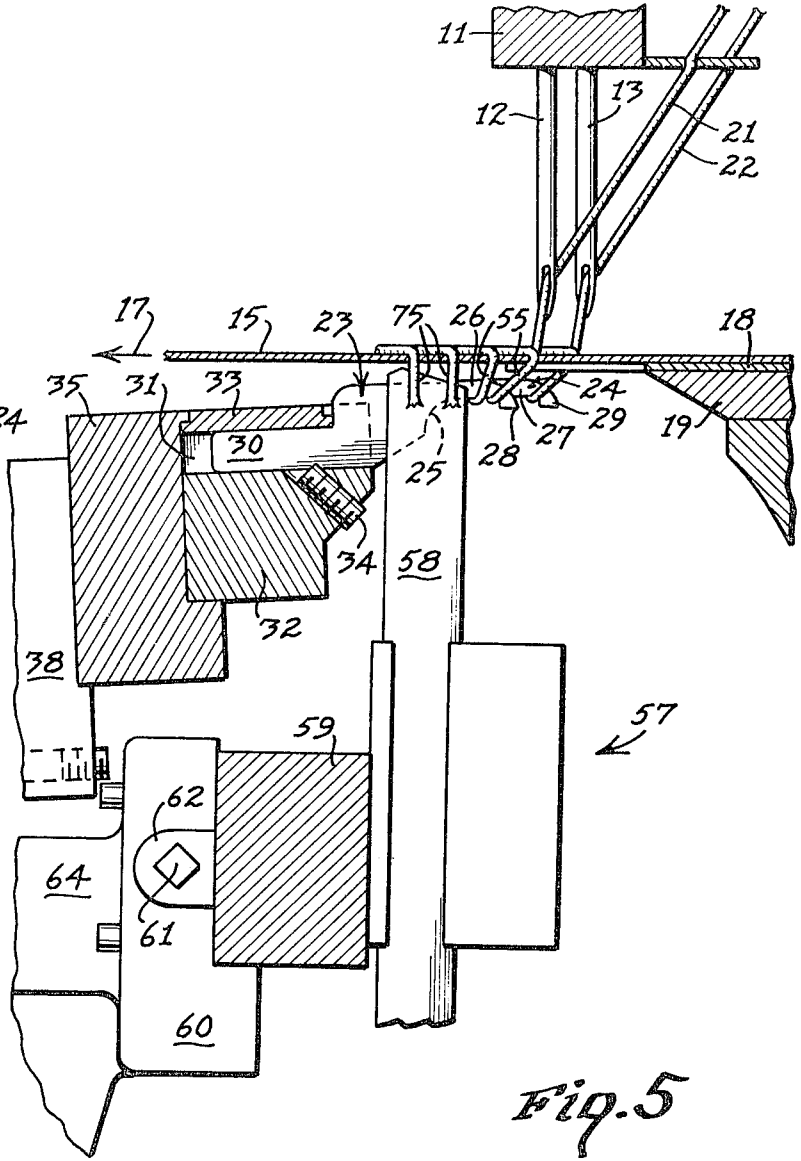
FIG. 5 is an enlarged, fragmentary elevation of a portion of the tufting machine including the needles, hooks, and knives, in a cutting position forming cut pile tufts.

Each of the hooks 23 and 24 has a shank 30 received in a corresponding slot 31 in a modular transverse hook bar 32 and retained in place by a transverse cap 33 and an angular set screw 34 (FIG. 5). The cap 33 and the hook bar 32 are in turn secured in a transverse back-up bar 35.

The back-up bars 35 are detachably secured by threaded bolts 37 to a plurality of transverse looper brackets 38 forming the upper end portions of corresponding looper rocker arms 39.

The lower portion of each rocker arm 39 forms a pair of clamp jaws 40 and 41 secured by bolts 42 in a fixed position upon the rotary hook shaft 44, journaled for rotary reciprocal movement in the machine frame 20.

The looper rocker arm 39 is driven in a reciprocal motion about the rotary axis of the hook shaft 44 by a drive or jack shaft 45, which is reciprocally driven about its own rotary axis by a drive mechanism, not shown, forming a part of the tufting machine 10 and of conventional construction.

Clamped to the jack shaft 45 is a split rocker arm member 46 including an upper rocker arm portion 47 and a lower rocker arm portion 48. A looper link bar 50 is pivotally connected to the upper rocker arm portion 47 by pin 51, while the other end of the looper link bar 50 is pivotally connected by pin 52 to an upper portion of the looper rocker arm 39. Thus, when the jack shaft 45 is driven in one rotary direction, such as the clockwise direction indicated by the arrow in FIG. 1, the looper hooks 23 and 24 move across the needle paths to pick up or seize the corresponding yarns 21 and 22 in order to form yarn loops, such as 55 (FIG. 5). When the jack shaft 45 is counter-rotated in a counterclockwise direction, as indicated by the arrow in FIG. 2, the loop hooks 23 and 24 are retracted from the needle paths to carry the seized yarn loops 55 with them, as indicated in FIG. 5.

The looper structure disclosed thus far is known in the art, as substantially illustrated in FIG. 1 of the prior R. T. Card U.S. Pat. No. 4,048,930.

The cutting mechanism 57, made in accordance with this invention, includes a plurality of knives 58 of uniform and conventional construction, which are transversely aligned and received in one or more conventional knife holders or knife bars 59. The knife bars 59 may be of any desired length and may be fabricated in modular sections. The knife bars 59 are detachably and transversely adjustably received in a plurality of transversely spaced knife brackets 60. The transverse adjustment mechanism for the knife bar may consist of a transversely extending threaded adjustment bolt 61 engaging an internally threaded ear 62 projecting from the knife bar 59. The operative end of the adjustment bolt 61 is journaled for free rotary, but non-axial, movement in the end of the knife bracket 60.

The knife bracket 60 is fixed to, or integrally formed upon, an arm 64 projecting forward from the intermediate portion of a lever member 65.

Figure 4:
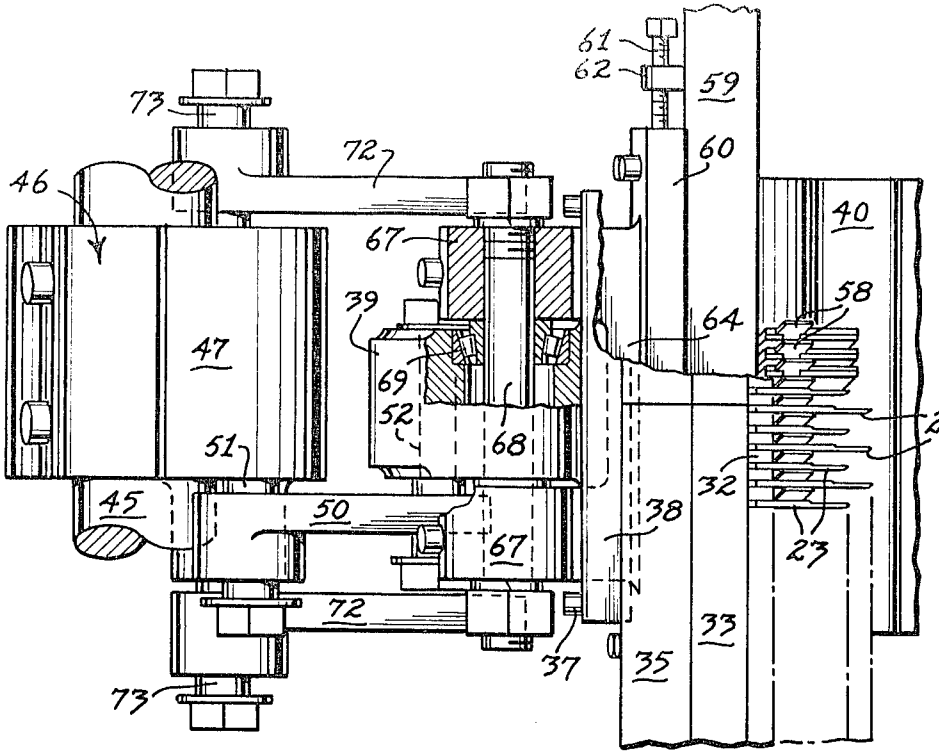
FIG. 4 is a fragmentary plan section taken along the line 4—4 of FIG. 1, with portions broken away.

The lever member 65 is bifurcated to include a pair of lever arms 66, which straddle the looper rocker arm 39. The upper end portions of the lever arms 66 comprise generally hook-shaped clamp members 67 adapted to fit over a transverse pivot shaft 68 extending through and journaled within the upper portion of the looper rocker arm 39 such as by the thrust bearings 69 (FIG. 4).

The lower end portions of the lever arms 66 are pivotally connected to the front end portions of knife drive link bars 72 by corresponding, transverse pivot pins 71. The opposite ends of the knife drive link bars 72 are pivotally joined to the lower rocker arm portions 48 by the pivot pins 73.

The arrangement of the link bars 50 and 72, respectively, above and below the pivotal axis of the jack shaft 45 permits the lever members 65 and the looper rocker arm 39 to always move or reciprocate in opposite directions as the jack shaft 45 reciprocally rotates. When the jack shaft 45 rotates in the clockwise direction of the arrow in FIG. 1, the looper rocker arm 39 is moved forward, while the lever members 65 pivot rearwardly. When the jack shaft 45 is counter-rotated in the counterclockwise direction of the arrow in FIG. 2, then the lever members 65 are moved forwardly while the looper rocker arm 39 is moved rearwardly. Thus, when the jack shaft 45 is rotated clockwise, as illustrated in FIG. 1, the looper hooks 23 and 24 are moved forwardly across the needles 12 and 13 to catch the respective yarn loops 55, while the knives 58 move downward to open the throat areas of the hooks to permit the loops to be seized without being cut. On the other hand, when the jack shaft 45 is reciprocated in the counterclockwise direction of FIG. 2, looper hooks 23 and 24 are retracted or moved rearwardly while the knives 58 pivot upward along the throats and across the respective bills to cut the loops, as illustrated in FIG. 5, to form cut pile tufts 75.

Because of the elevated position of the pivotal axis of the pivot pin 68, which is almost at the same elevation as the loopers 23 and 24, there is little longitudinal movement of the knives 58, with most of the reciprocal movement of the knives 58 being vertical relative to the loop hooks 23 and 24, to provide a more effective and more efficient shearing or scissors action between the respective knives 58 and their corresponding loop hooks 23 and 24.

Furthermore, the elimination of the conventional knife shaft by the substitution of the cutting mechanism 57 in the looper apparatus for the tufting machine 10, consolidates the looper and cutting apparatus below the bed plate 19 to provide more room in the space beneath the bed plate 19, not only for the operation of the mechanical elements, but also to enhance the visibility of the loopers and knives from beneath the machine for inspection and maintenance. Moreover, the cutting mechanism 57 provides more accessibility to the elements of the mechanism for maintenance, adjustment, and replacement of parts.

The cutting mechanism 57 made in accordance with this invention provides a more direct linkage between the knife bar 59 and the hook bar 32, so that the synchronous drive of these elements is more consistent and precise, as opposed to connecting an independent looper shaft and an independent hook shaft through conventional linkage elements at the ends of the respective shafts. Moreover, the more direct linkage between the hook bar 32 and the knife bar 59 provided by the cutting mechanism 57, eliminates a multitude of connecting elements, and therefore the corresponding opportunities for defects and for maintenance of such elements. By reciprocally driving a single jack shaft 45, the reciprocal movement of the hook bar 32 and knife bar 59 is instantly effected with greater coordination, than the separate driving of an independent hook bar or shaft and an independent knife shaft.

It will also be understood that the cutting mechanism 57 may be connected with, and utilized with, a looper apparatus, in which identical looper hooks are supported in transverse alignment for cooperation with corresponding in-line needles.

What is claimed is:

1. In a cut pile tufting machine having means for supporting the base fabric for longitudinal movement in a feeding direction through the machine, a plurality of transversely spaced reciprocal needles for introducing yarns through one side of the base fabric to form loops, a looper hook for each needle mounted on a transverse hook bar, a looper rocker arm supporting the hook bar for reciprocal movement on the other side of the base fabric, and looper drive means for reciprocally moving the rocker arm to cause the looper hooks to cooperate with the corresponding needles for seizing the yarn loops from the needles, a loop cutting apparatus comprising:

(a) a lever member having a pivotal portion and driven portion spaced from said pivotal portion, (b) journal means pivotally connecting said pivotal portion to the looper rocker arm at a transverse pivotal axis spaced a proximal distance from the feeding path of the base fabric and spaced longitudinally from the looper hook a distance substantially greater than said proximal distance, (c) a transversely extending, elongated knife bar mounted on said lever member, (d) a knife for each looper hook mounted on said knife bar for cooperative engagement with a corresponding looper hook for cutting a loop thereon, and (e) knife drive means operatively connected to said driven portion for reciprocally swinging said lever member about said pivotal axis synchronously with the movement of the looper rocker arm.

2. The invention according to claim 1 in which said knives comprise knife edges cooperating with said corresponding looper hooks, and a plane containing said pivotal axis and intersecting said knife edges being more nearly parallel than perpendicular to the plane of movement of the base fabric.

3. The invention according to claim 2 in which the movement of each knife relative to the bill of each corresponding hook is substantially perpendicular.

4. The invention according to claim 1 in which the plane of movement of said base fabric is substantially horizontal, said needles being above the base fabric and the looper hooks and knives being below the base fabric, said knife bar being spaced below the hook bar, and means attaching said hook bar to said lever member below said pivotal axis.

5. The invention according to claim 4 in which said driven portion of said lever member is below said hook bar.

6. The invention according to claim 5 in which the lower portion of the looper rocker arm is mounted upon a reciprocal rotary hook shaft, and the looper drive means comprises a drive shaft having a first link bar pivotally connecting the drive shaft to the looper rocker arm, said knife drive means comprising a second link bar pivotally connecting said drive shaft to the driven portion of said lever member for simultaneous reciprocal movement of the looper hooks and knives.

7. The invention according to claim 6 in which said first link bar has opposite ends, one end being pivotally connected to the looper rocker arm and the other end being connected to the drive shaft above the rotary axis of the drive shaft, said second link bar having opposite ends, one end of which is pivotally connected to the driven portion of the lever arm and the other end is connected to the drive shaft below said rotary axis, whereby rotary movement of the drive shaft in either rotary direction causes the looper rocker arm and the lever member to rotate simultaneously in opposite directions from each other relative to said pivotal axis.

8. The invention according to claim 7 further comprising a transverse knife bracket forming a part of said lever member, means mounting said knife bar in said knife bracket for relative transverse movement to permit adjustment of the relative transverse positions of the knives and the hooks.

9. The invention according to claim 8 in which said adjustment means comprises threaded cooperative transverse adjustment elements mounted on said knife bracket and said knife bar.

* * * * *